US007219678B2

(12) United States Patent
Nakano et al.

(10) Patent No.: US 7,219,678 B2
(45) Date of Patent: May 22, 2007

(54) DISHWASHER

(75) Inventors: Hiroyuki Nakano, Osaka (JP); Yoshikazu Shinchi, Osaka (JP); Shigeru Kubota, Osaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 277 days.

(21) Appl. No.: 10/667,424

(22) Filed: Sep. 23, 2003

(65) Prior Publication Data

US 2004/0085005 A1 May 6, 2004

(30) Foreign Application Priority Data

Nov. 5, 2002 (JP) ..... 2002-320948

(51) Int. Cl.
*B08B 3/02* (2006.01)

(52) U.S. Cl. ..... 134/183; 134/200

(58) Field of Classification Search ..... 68/3 R, 68/196; 134/200, 182, 183
See application file for complete search history.

(56) References Cited

U.S. PATENT DOCUMENTS 1,443,352 A * 1/1923 Dysthe ..... 312/270.3
2,000,334 A * 5/1935 Kahn ..... 126/39 N
2,654,386 A * 10/1953 Wotring ..... 137/216.1
2,661,750 A * 12/1953 McNairy ..... 134/115 R
2,667,400 A * 1/1954 Wotring ..... 312/331
2,763,526 A * 9/1956 Falek ..... 312/270.3
3,222,113 A * 12/1965 Hamilton et al. ..... 312/195
3,528,718 A * 9/1970 Braun et al. ..... 312/308
3,824,920 A * 7/1974 Gladwin ..... 100/349
3,861,296 A * 1/1975 Clar ..... 100/343
4,317,607 A * 3/1982 Gomolka ..... 312/236
4,448,465 A * 5/1984 Yonenaka ..... 312/223.6
5,222,789 A * 6/1993 Yoshikawa ..... 312/270.3
5,755,244 A * 5/1998 Sargeant et al. ..... 134/46
6,244,277 B1 * 6/2001 Maunsell ..... 134/60
6,260,565 B1 * 7/2001 Welch et al. ..... 134/200
6,491,049 B1 * 12/2002 Tuller et al. ..... 134/200

FOREIGN PATENT DOCUMENTS

DE 24 02 624 * 7/1975
DE 195 46 984 * 6/1997

(Continued)

OTHER PUBLICATIONS

WIPO WO 01/26532 Apr. 2001.*

(Continued)

*Primary Examiner*—Frankie L. Stinson
(74) *Attorney, Agent, or Firm*—Bacon & Thomas PLLC

(57) ABSTRACT

A dishwasher includes a main body being generally of a box shape with an open front, a washer tub being slidably extracted from and retracted into the main body through the open front, the washer tub having an open top, and a covering member for blocking a gap to be opened between the washer tub and the main body when the washer tub is fully extracted from the main body. Therefore, when the washer tub is fully extracted from the main body, a rear end of an inner wall of the washer tub is located in front of a front end of the main body to open the gap and the opened gap is covered by the covering member.

20 Claims, 16 Drawing Sheets

FOREIGN PATENT DOCUMENTS

| | | | |
|---|---|---|---|
| DE | 197 00 149 | * | 7/1998 |
| JP | 2000-166850 | | 6/2000 |
| JP | 2001-61745 | | 3/2001 |
| JP | 2001-061746 | | 3/2001 |
| JP | 2001-224450 | * | 8/2001 |
| JP | 2002-28123 | * | 1/2002 |
| JP | 2002-65560 | * | 3/2002 |
| JP | 2002-65570 | * | 3/2002 |
| JP | 2002-209828 | * | 7/2002 |
| JP | 2002-272547 | * | 9/2002 |
| JP | 2002-315714 | * | 10/2002 |
| JP | 2004-49443 | | 2/2004 |

OTHER PUBLICATIONS

European Patent Office 0 864 277 Feb. 1998.*

* cited by examiner

DISHWASHER

FIELD OF THE INVENTION

The present invention relates to a dishwasher including a covering member for hiding a gap to be opened between a washer tub and a main body of the dishwasher when the washer tub is fully extracted so as to facilitate the process of charging and discharging of the dishware into and from the washer tub.

BACKGROUND OF THE INVENTION

In the slide opening type(or a drawer type, top loading) dishwasher, a washer tub for accommodating and cleaning the dishware is extracted from and retracted into a main body of the dishwasher in a to-and-fro direction by means of slide rail assemblies. Such a slide opening type dishwasher is preferably built in a kitchen cabinet to establish a system kitchen capable of mounting therein a dishwasher.

Referring to FIG. 17, there is shown one of prior art slide opening type disclosed in Japanese Patent No. 3129318. As shown, the slide opening type dishwasher includes washer tub 14 having an open top and main body 15 having an open front. Washer tub 14 is coupled with main body 15 in such a manner it can be slidably moved into and out of main body 15 through the open front of main body 15. Such sliding movement of washer tub 14 is achieved by a slide assembly. The slide assembly has a pair of first slide rails 16(only one shown) secured on both inner side surfaces of main body 15 and a pair of second slide rails 17(only one shown) fixed on both outer side surfaces of washer tub 14. Between first and second slide rails 16 and 17 are provided rotating bodies, e.g., ball bearings. This allows second slide rails 17 fixed at washer tub 14 to slidably move along first slide rails 16, enabling washer tub 14 to be smoothly extracted from and retracted into main body 15.

The dishwasher described above suffers from certain drawbacks. For example, even when washer tub 14 is fully extracted from main body 15, a rear section thereof still remains inside main body 15. In other words, the rear section of washer tub 14 is covered with main body 15. For this reason, it is rather difficult to charge and discharge the dishware in and from the rear section.

When washer tub 14 is fully extracted from main body 15, a gap will be opened between the rear section of thus extracted washer tub 14 and main body 15. Particularly, in case electric parts such as a washing pump are provided behind washer tub, some of the electric parts are exposed, spoiling the appearance. Further, if child's hand or metallic substances are inserted through the gap, it may cause an accident or a failure of the equipment. Accordingly, a scheme for blocking the gap is required.

SUMMARY OF THE INVENTION

It is, therefore, an object of the present invention to provide a dishwasher enabling a washer tub to be extracted from a main body of the dishwasher sufficiently enough not to be blocked thereby, the dishwasher including a covering member for blocking a gap to be opened between the washer tub and the main body when the washer tub is fully extracted from the main body.

In accordance with a preferred embodiment of the present invention, there is provided a dishwasher which includes a main body being generally of a box shape with an open front; a washer tub being extracted from and retracted into the main body through the open front by means of slide rail assemblies, the washer tub having an open top; and a covering member for blocking a gap to be opened between the washer tub and the main body when the washer tub is fully extracted from the main body, wherein, when the washer tub is fully extracted from the main body, a rear end of an inner wall of the washer tub is located in front of a front end of the main body to open the gap and the opened gap is covered by the covering member.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF PREFERRED EMBODIMENTS

Figure 1:
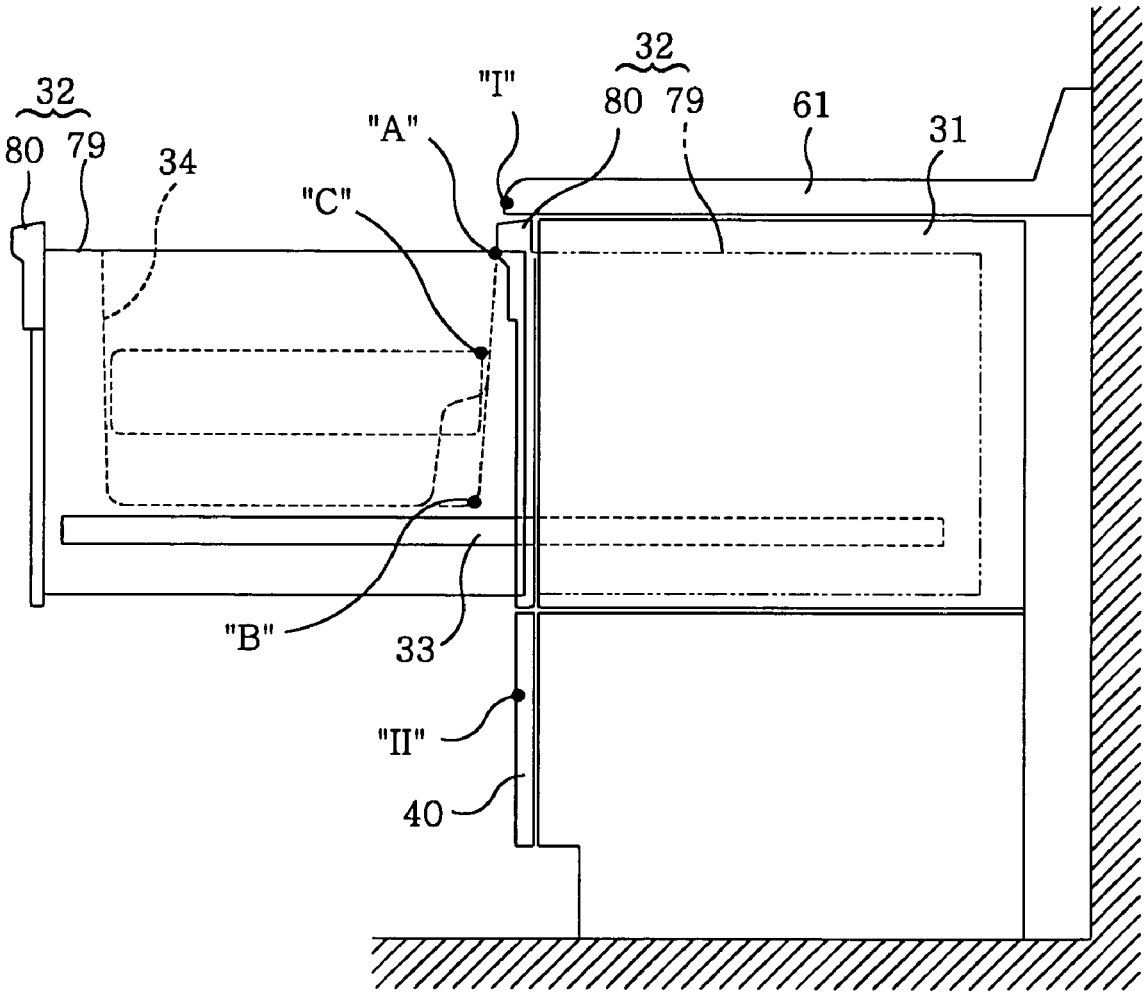
FIG. 1 is a schematic side view of a dishwasher in accordance with a preferred embodiment of the present invention with a washer tub thereof extracted from a main body.

Referring to FIG. 1, there is provided a schematic side view of a dishwasher in accordance with the present invention.

As shown, the dishwasher includes main body 31 having an open front and accommodating therein washer tub 32, a top of washer tub 32 being opened. Washer tub 32 is coupled with main body 31 in such a manner that it can be movable in a to-and-fro direction by means of a pair of slide rail assemblies 33(only one shown), so that washer tub 32 can be fully extracted from main body 31 up to a fully extraction position thereby. The dishwasher explained above is preferably built in kitchen cabinet 40 but can be also fixedly installed on a mounting base.

Figure 2:
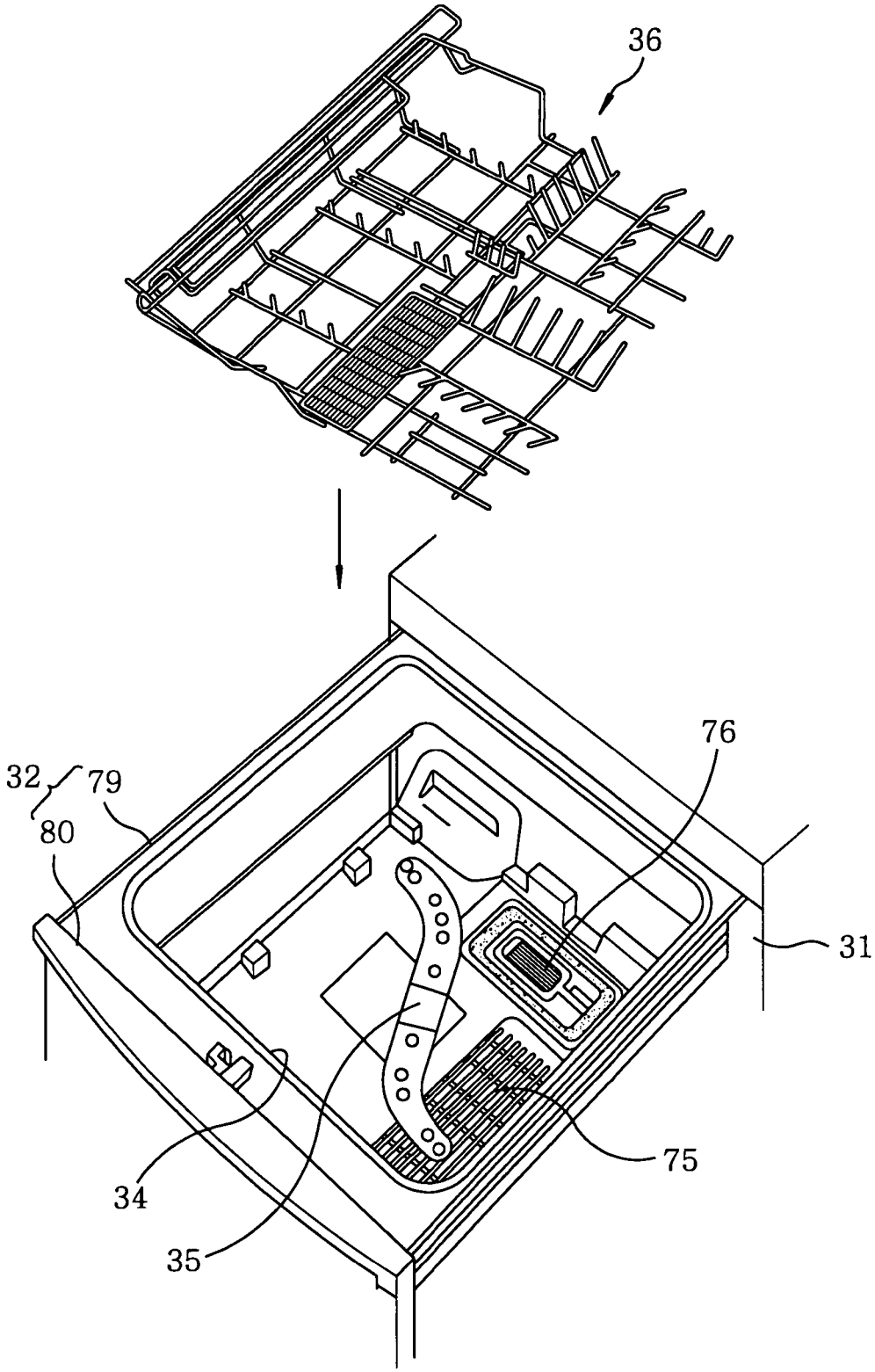
FIG. 2 provides an exploded perspective view illustrating an inner structure of an inner tub of the washer tub.
Figure 3:
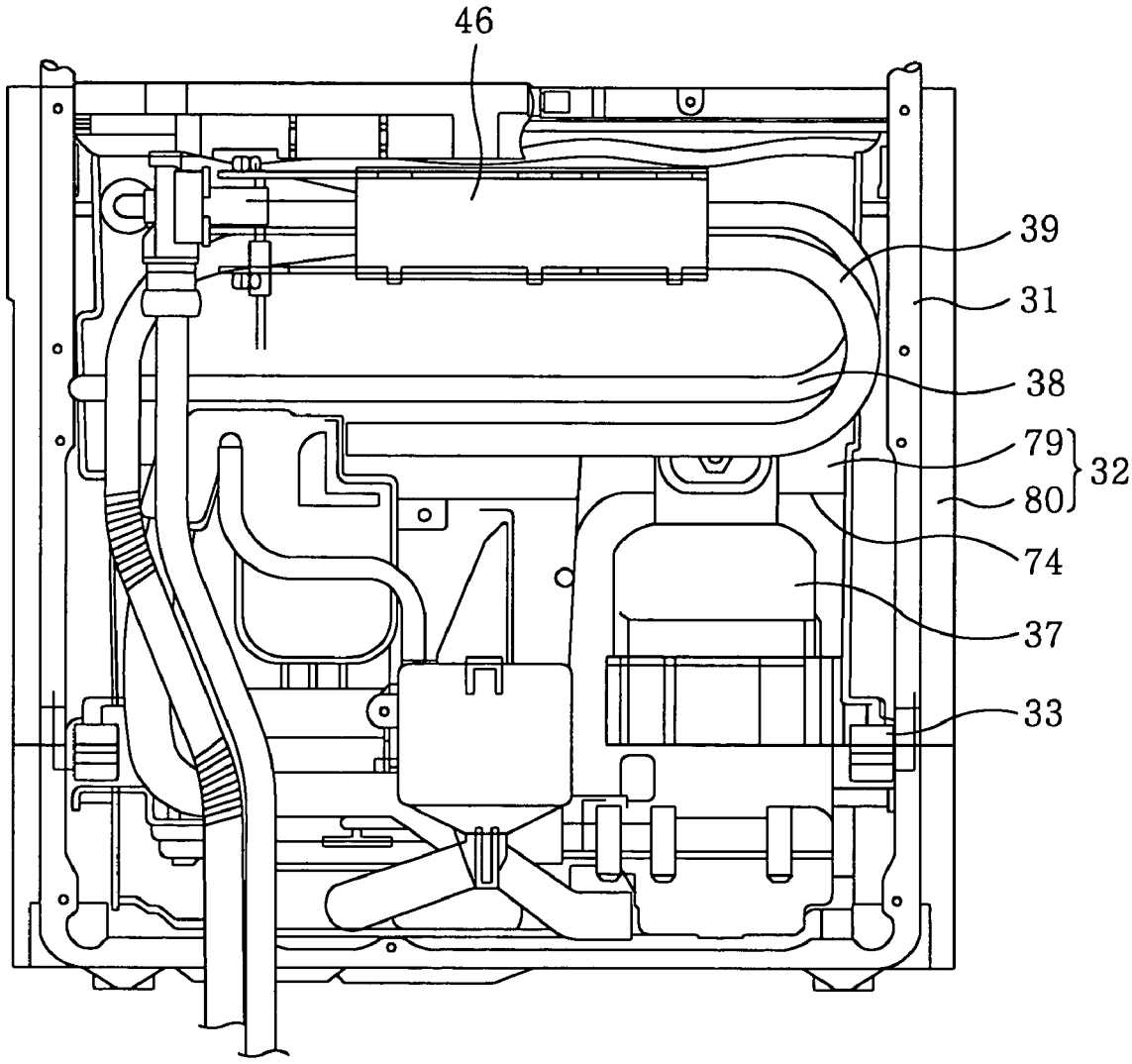
FIG. 3 illustrates a rear view of a water feed and drain unit disposed behind the washer tub.
Figure 4:
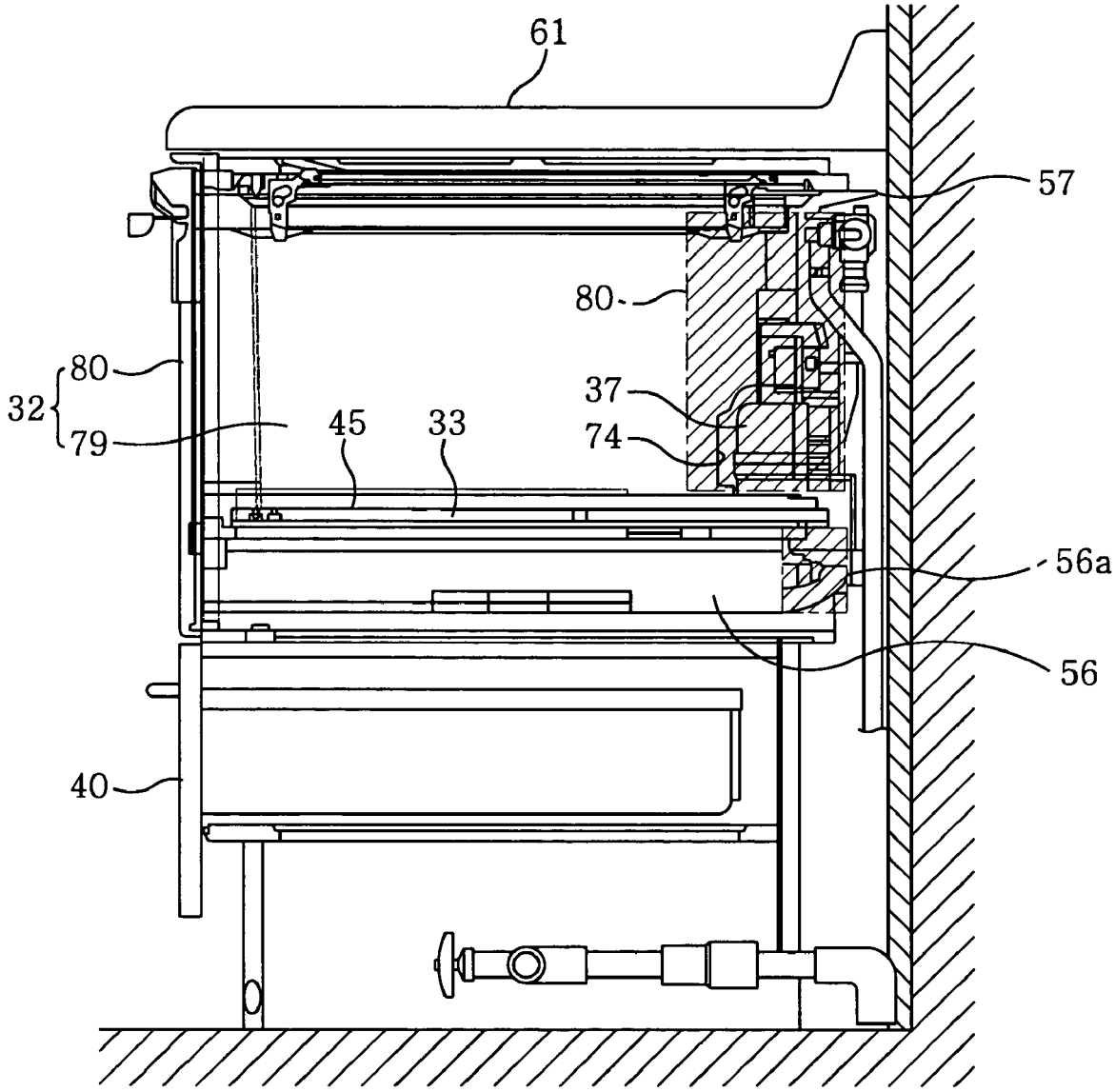
FIG. 4 depicts a side view of the dishwasher with a side panel thereof removed.

Washer tub 32 made by, e.g., a resin molding includes tank 79 and door panel 80 provided at a front portion of tank 79. As shown in FIG. 2, inner tub 34 formed in tank 79 has such a tapered configuration that its open area increases gradually when moving upwards, and has at its bottom surface wash nozzle 35, heater 75, filter 76 for removing food remnants. Detachably mounted on inner tub 34 is basket 36 for accommodating therein the dishware. Further, as shown in FIGS. 3 and 4, provided behind washer tub 32 are electric pump 37 serving as a drain pump as well as a washing pump for spraying washing fluid via wash nozzle 35 and a water feed and drain unit for feeding and draining water to and from inner tub 34. The water feed and drain unit has water feed hose 38 and drain hose 39 coupled to the inside of inner tub 34. Water feed hose 38 and drain hose 39 are supported by hose holder 46, which is rotatably mounted in main body 31 such that it can rotate in harmony with the forward and backward movement of washer tub 32. This secures a stable connection between hoses 38, 39 and washer tub 32.

Figure 5:
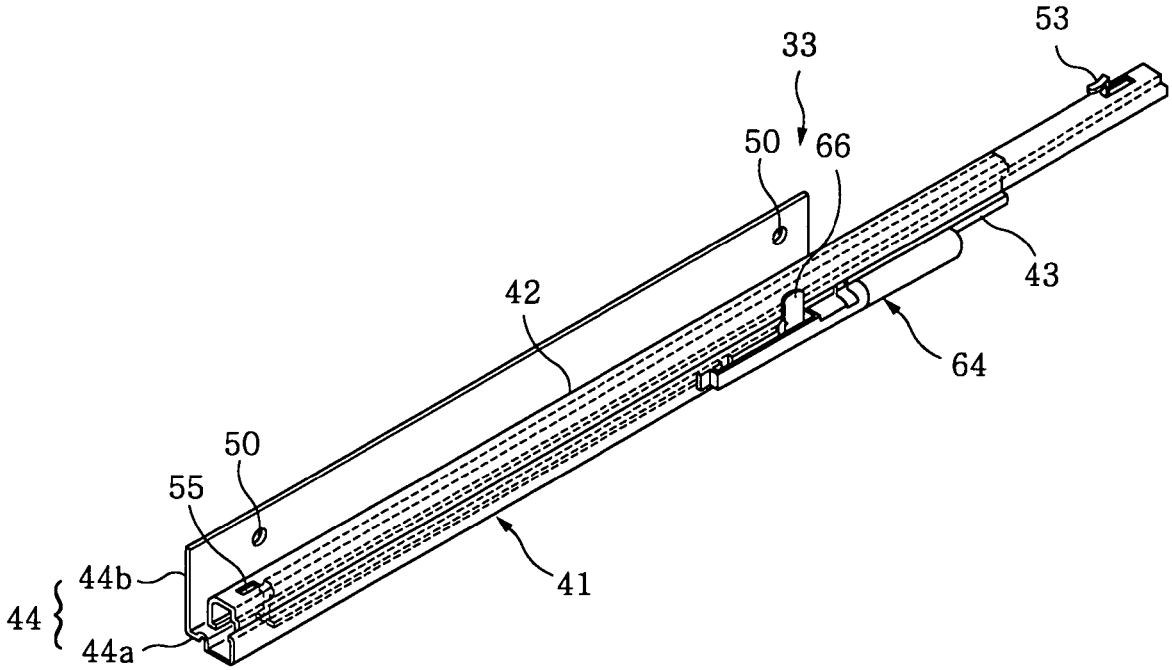
FIG. 5 shows a perspective view of a slide rail assembly of the present invention.
Figure 6:
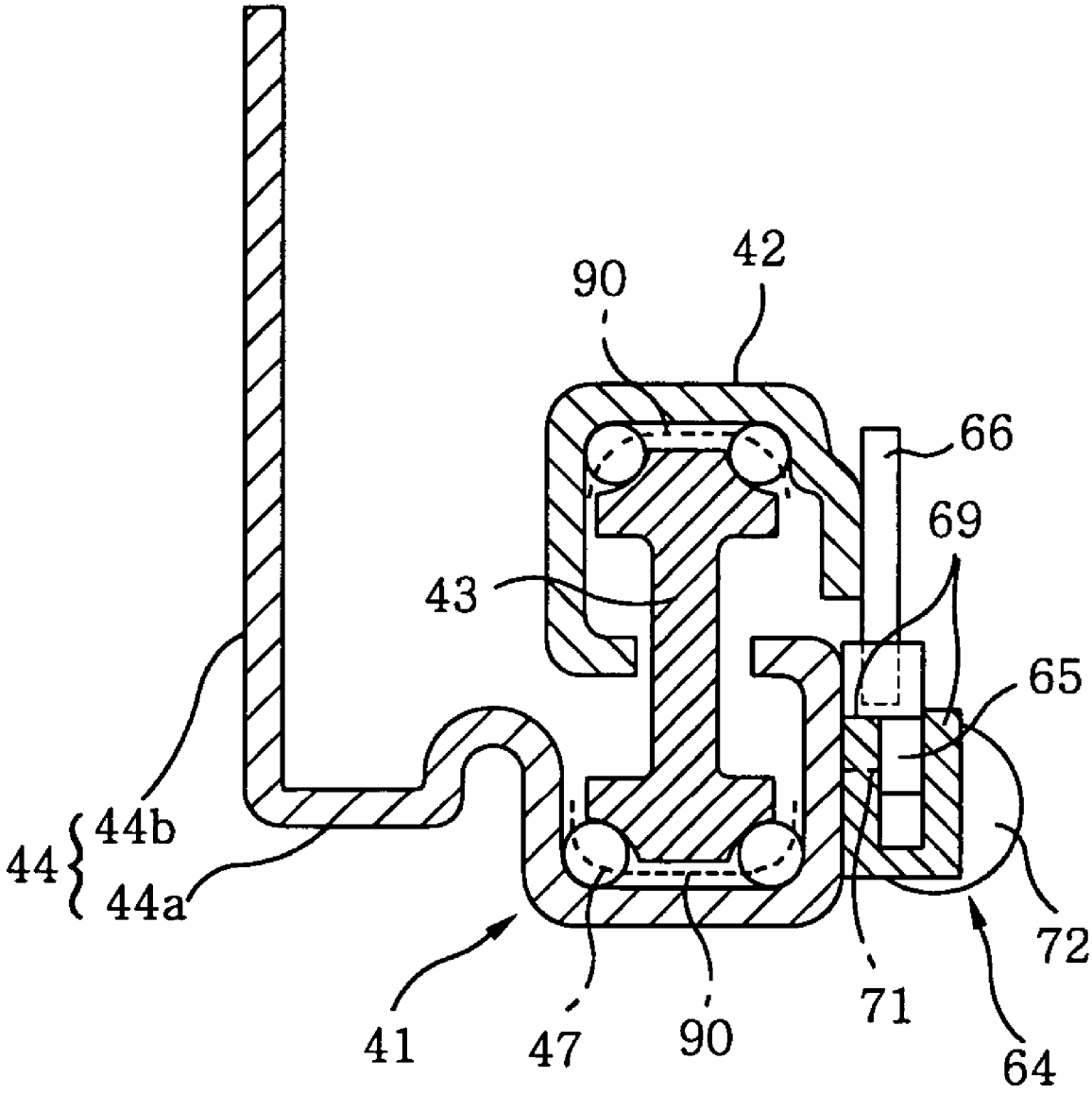
FIG. 6 presents a cross sectional view of the slide rail assembly shown in FIG. 5.
Figure 7:
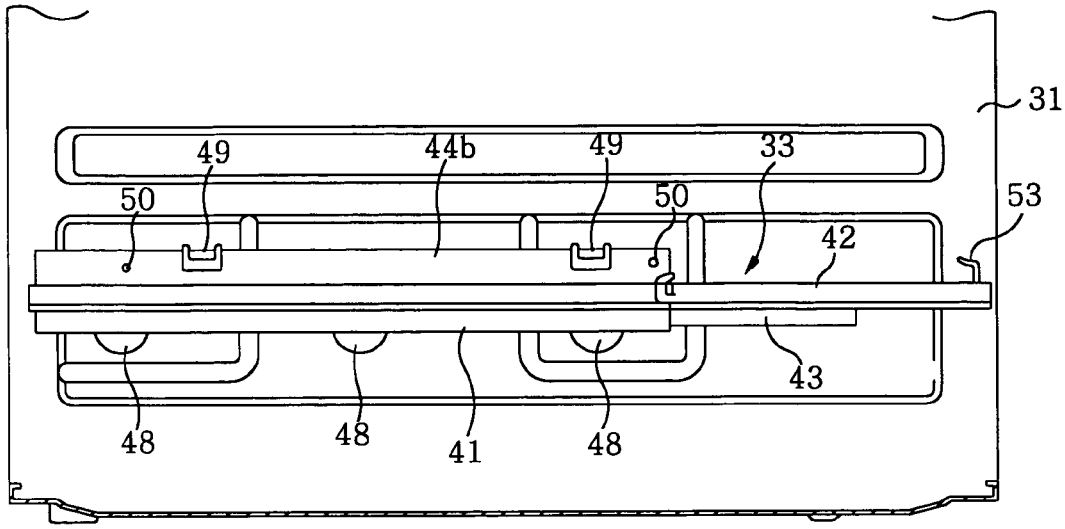
FIG. 7 represents a side view of the slide rail assembly shown in FIG. 5 mounted at the dishwasher.
Figure 8:
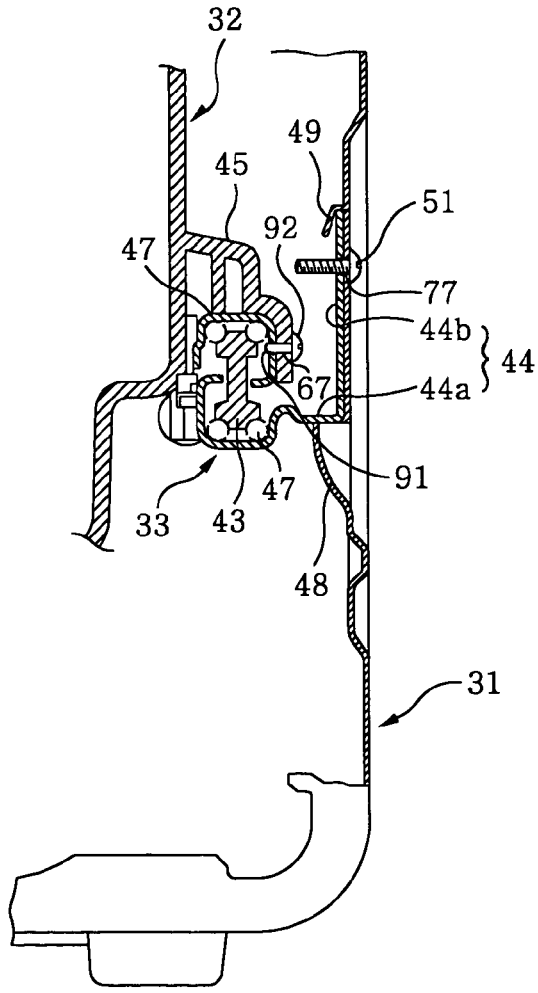
FIG. 8 describes a partial cutaway cross sectional view of the dishwasher showing the slide rail assembly mounted thereat.
Figure 9:
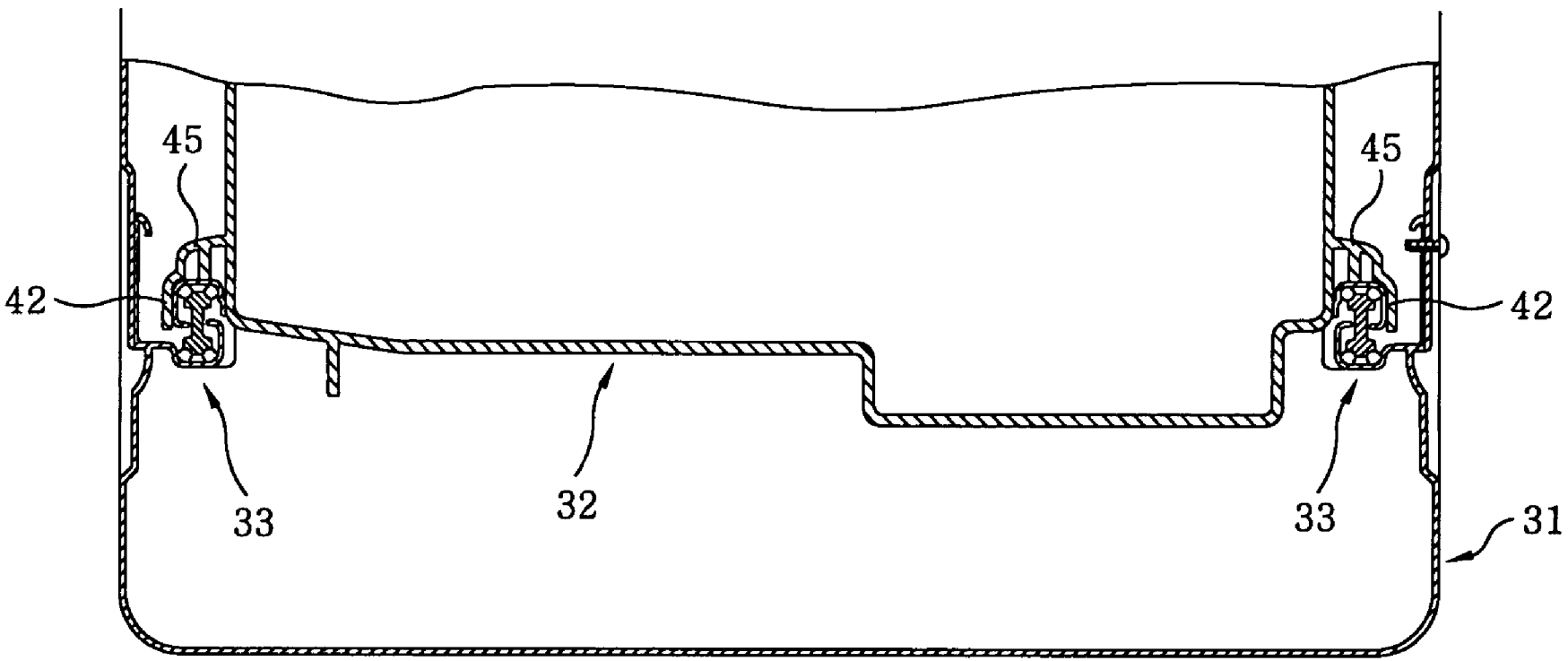
FIG. 9 discloses a partial cross sectional view of the dishwasher showing the slide rail assembly installed thereat.

As shown in FIGS. 5 and 6, each of slide rail assemblies 33 has a triplex rail structure including fixed rail 41, movable rail 42 and middle rail 43 interposed therebetween via ball bearings 47. Fixed rail 41 is provided with engagement member 44. Engagement member 44 has horizontal plane 44*a* extending from one side of fixed rail 41 and vertical plane 44*b* extending perpendicularly from horizontal plane 44*a*, thereby being generally of an L shape in cross section. As shown in FIGS. 7, 8 and 9, fixed rails 41 are respectively mounted at two facing inner side surfaces of main body 31 and movable rails 42 are respectively installed at two opposite outer side surfaces of washer tub 32.

Main body 31 made of, e.g., sheet metal is generally of a front-opened box shape and is provided at its both side surfaces with supports 48 and clamps 49 for holding engagement member 44 therebetween as shown in FIGS. 7 and 8. Supports 48 and clamps 49, in concert with each other, accommodate engagement member 44 therebetween to temporarily support slide rail assembly 33. As shown in FIG. 8, support 48 and clamp 49 are provided by forming protrusions on the inner side surfaces of main body 31 in such a manner that the vertical distance therebetween corresponds to a height of vertical plane 44*b* of engagement member44. In such a structure, slide rail assembly 33 is temporarily held on one inner side surface of main body 31 by inserting a top of vertical plane 44*b* of engagement member 44 into clamps 49 and pushing horizontal plane 44*a* thereof onto supports 48. Subsequently, thus temporarily installed slide rail assembly 33 is mounted on main body 31 by tightening two screws 51 from two through holes 77 formed at main body 31 to two tapped holes 50 of engagement member 44 formed at locations corresponding to through holes 77.

Figure 12:
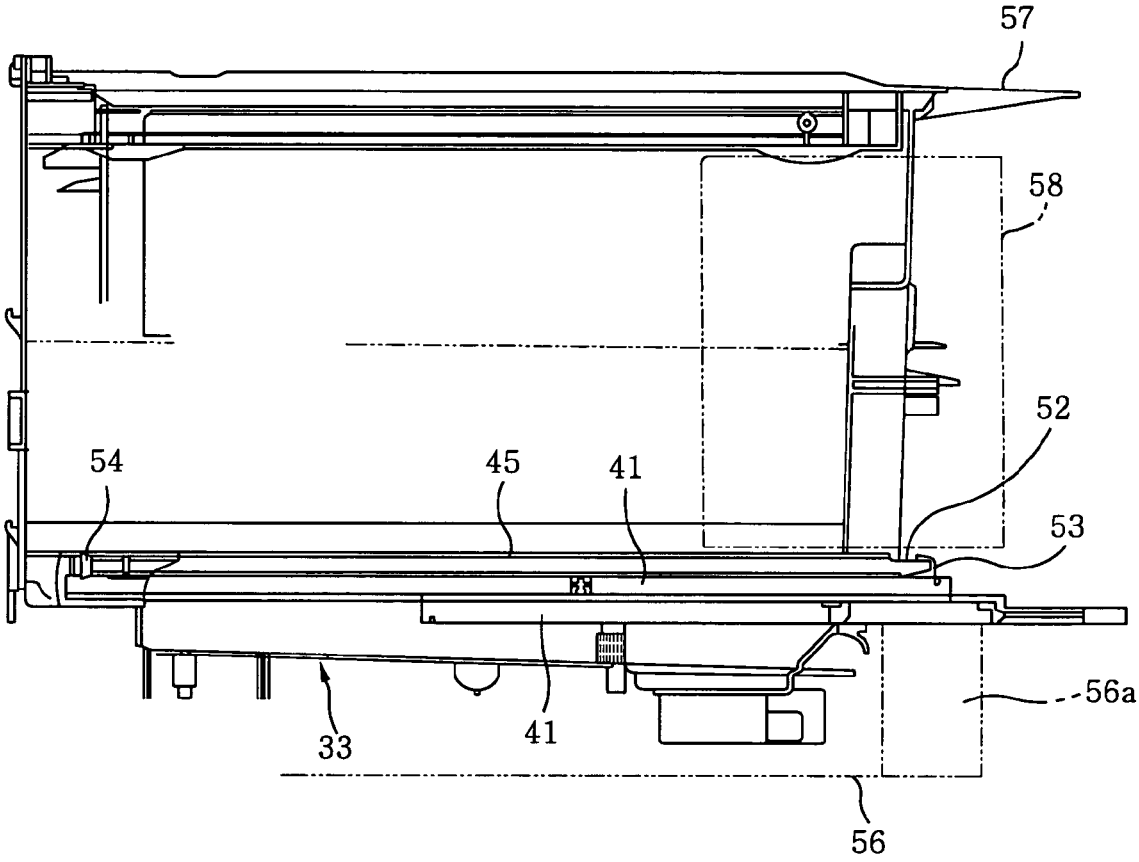
FIG. 12 gives a side view of the washer tub in accordance with the present invention.

As shown in FIG. 9, tank 79 of washer tub 32 is provided with a pair of coupling portions 45, extending outward from both outer side surfaces thereof for the connection with movable rails 42. As shown in FIG. 12, each of coupling portions 45 has fitting protrusion 52 extending backward from a rear end thereof and inserting protrusion 54 extending downward from a front portion thereof. When washer tub 32 is slidably pushed into main body 31 after setting tank 79 on movable rails 42 by putting coupling portions 45 thereon, fitting protrusion 52 is fitted into inverted L-shaped cutoff 53 protruded at a rear section of movable rail 42 and protrusion 54 is inserted into opening 55 provided at a front section thereof(see FIG. 5), enabling washer tub 32 to be firmly installed in position on slide rail assemblies 33. In order to establish a secure coupling of washer tub 32 and slide rail assemblies 33, at least one screw 92 is tightened from at least one through hole 67 formed at a front portion of coupling portion 45 to at least one tapped hole 91 formed at movable rail 42, as shown in FIG. 8.

Slide rail assemblies 33 have the triplex rail architecture as described above. Therefore, when washer tub 32 is extracted from main body 31, movable rails 42 mounted on washer tub 32 smoothly travel on middle rails 43 first, and then middle rails 43 begins to move on fixed rails 41.

Figure 10A:
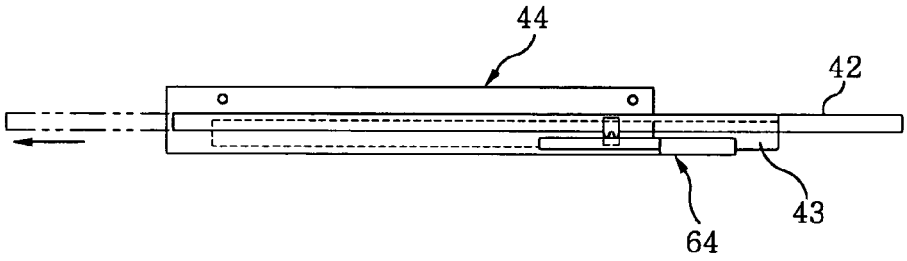
FIGS. 10A and 10B offer respective side views for setting forth an operation of the slide rail assembly.
Figure 10B:
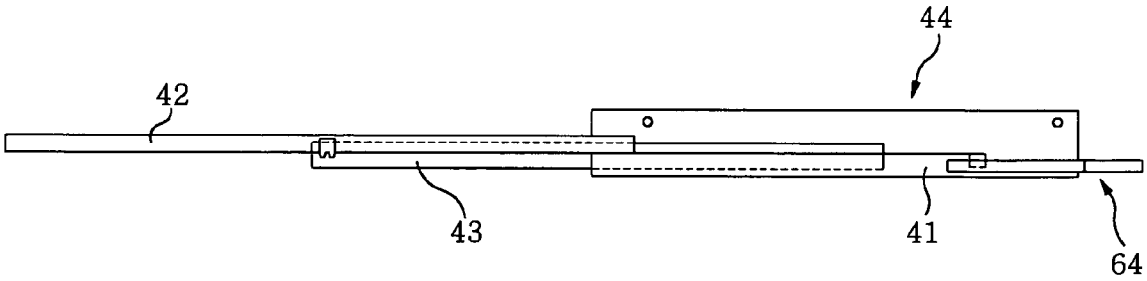

A sliding process of slide rail assembly 33 will now be described in detail with reference to FIGS. 10A and 10B. FIG. 10A represents a side view of slide rail assembly 33 when washer tub 32 is accommodated in main body 31 and FIG. 10B depicts same when washer tub 32 is fully extracted from main body 31. When extracting operation of washer tub 32 starts as shown in FIG. 10A, movable rails 42 fixed at washer tub 32 begin to move on middle rails 43 as indicated by a phantom line. Movable rails 42 move by a predetermined distance in such a manner that retainers 90 for maintaining ball bearings 47 inserted between movable rails 42 and middle rails 43 in position (see FIG. 6) are always interposed between movable rails 42 and middle rails 43. Then, middle rails 43 follow the movement of movable rails 42. Additional retainers 90 are provided between middle rails 43 and fixed rails 41 as well, for maintaining ball bearings 47 inserted therebetween in position. By virtue of such arrangement, when washer tub 32 is completely extracted as shown in FIG. 10B, about a half of a length of middle rail 43 corresponding to a length of retainer 90 remains on fixed rails 41 and the rest thereof extends therefrom. Similarly, about a half of a length of movable rail 42 stays on middle rail 43 and another remaining half thereof extends therefrom. As a result, it is possible to increase the amount of extraction of washer tub 32 from main body 31.

Further, since middle rail 43 is disposed between fixed rail 41 and movable rail 42 to increase the sliding distance of slide rail assembly 33, slide rail assembly 33 can support washer tub 32 stably even when washer tub 32 heavily weighs on movable rails 42 extending from fixed rails 41.

Washer tub 32 needs to be maximally extracted from main body 31, when the dishwasher is built in kitchen cabinet 40 below countertop 61 thereof, as shown in FIG. 1. In such an arrangement, normally front end "I" of countertop 61 is positioned in front of fore end "II" of kitchen cabinet 40 and the dishwasher is built in immediately below countertop 61, as shown in FIG. 1. In such a case, it is preferable to enable washer tub 32 to be extracted from main body 31 up to a position where rear top end "A" of inner tub 34 is located in front of front end "I" of countertop 61. Then, the entire open top of inner tub 34 is fully exposed without blockage, facilitating the process of charging and discharging the dishware into and from inner tub 34 and removing the remnants after the cleaning process.

Inner tub 34 has such a tapered configuration that its open area increases gradually when moving upwards. It is preferable that washer tub 32 is configured such that it can be extracted up to its fully extracted position where rear bottom end "B" of inner tub 34 is positioned in front of front end "I" of countertop 61. Alternatively, washer tub 32 may be configured such that when fully extracted rear top end "A"

of inner tub 34 is located in the back of front end "I" of countertop 61. In such a case, a small portion of open top of inner tub 34 will be covered with countertop 61. However, the process of charging and discharging the dishware into and from inner tub 34 would not be hindered thereby because the amount of covering is small and there exists a vertical gap between the lower surface of countertop 61 and rear top end "A" of inner tub 34.

Alternatively, washer tub 32 can be preferably designed to be fully extracted up to a location where upper top end "C" of basket 36 is positioned in front of front end "I" of countertop 61. In this case, since top of entire basket 36 is exposed without blockage, the process of charging and discharging the dishware into and from basket 36 can be carried out easily.

Figure 11:
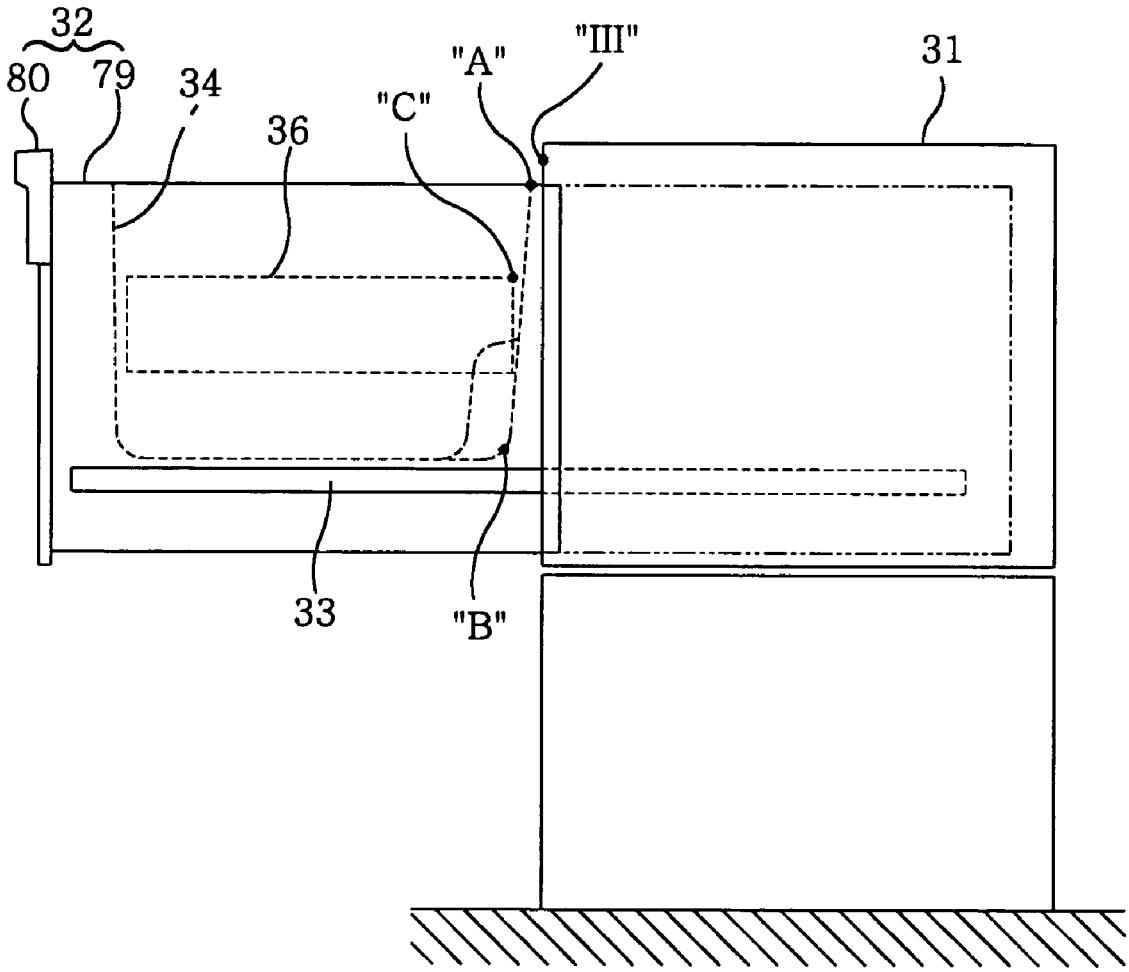
FIG. 11 delineates a schematic side view of the dishwasher setting forth the positional relationship between the washer tub and main body when the former is fully extracted from the latter.

In case washer tub 32 is installed in a place other than under a countertop-like object, it is preferable that washer tub 32 can be extracted in such a manner that, when fully extracted, at least one of rear top end "A" of inner tub 34, rear bottom end "B" thereof and upper top end "C" of basket 36 as shown in FIG. 11 is located in front of front upper end "III" of main body 31. Under the circumferences, it is possible to readily charge and discharge the dishware into and from washer tub 32 or remove remnants when necessary.

However, with large extraction of washer tub 32 described above, electric parts such as electric pump 37 disposed behind washer tub 32 may be exposed through the gap opened between a rear end of washer tub 32 and a front upper end III of main body 31. Particularly, in case electric pump 37 is accommodated in a space prepared by recessed portion 74 provided at the back of tank 79 as shown in FIG. 4, a large portion of electric pump 37 is exposed when washer tub 32 is completely extracted up to its fully extracted position, spoiling the appearance. Further, if child's hand or metallic substances are inserted through the gap to touch electric parts such as electric pump 37, it may cause an accident or a failure of the equipment. In order to solve these problems, the present invention includes a covering member for blocking the gap.

As shown in FIGS. 4 and 12, bottom cover 56 for hiding such parts as water pipes and connections therebetween is attached under coupling portion 45 of each side of washer tub 32 and extends downward therefrom up to a level below the bottom of washer tub 32. Each of the pair of bottom covers 56 has extended portion 56*a* extending from a rear end thereof as depicted by hatching in FIG. 4. Therefore, a space below the level of slide rail assemblies 33 can be concealed by bottom cover 56 and extended portion 56*a*.

Figure 13A:
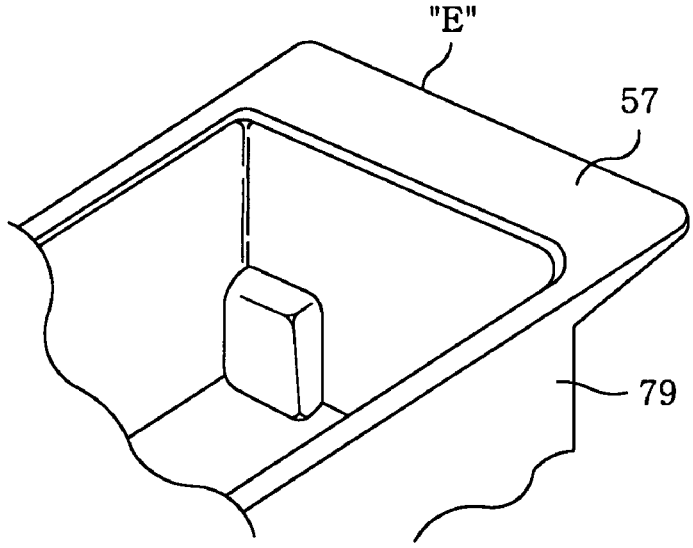
FIGS. 13A and 13B demonstrate respective partial perspective views of the washer tub showing various extension members provided on the top rear end of the washer tub in accordance with the present invention.
Figure 13B:
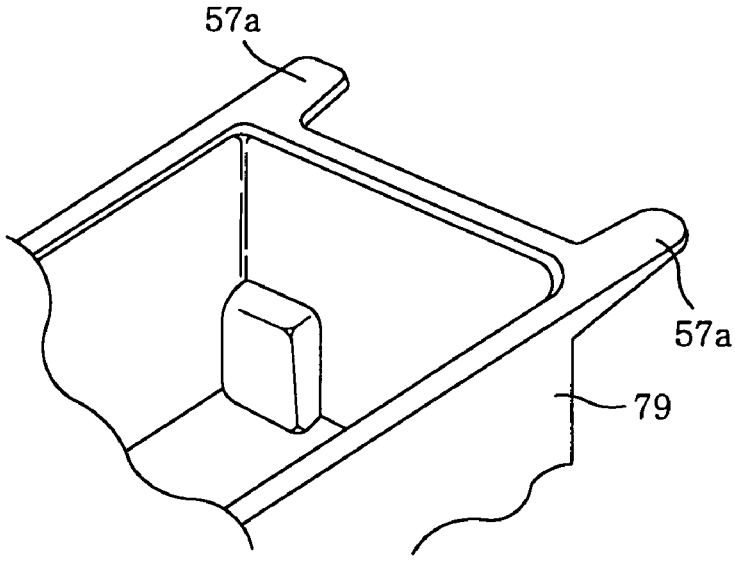
Figure 15:
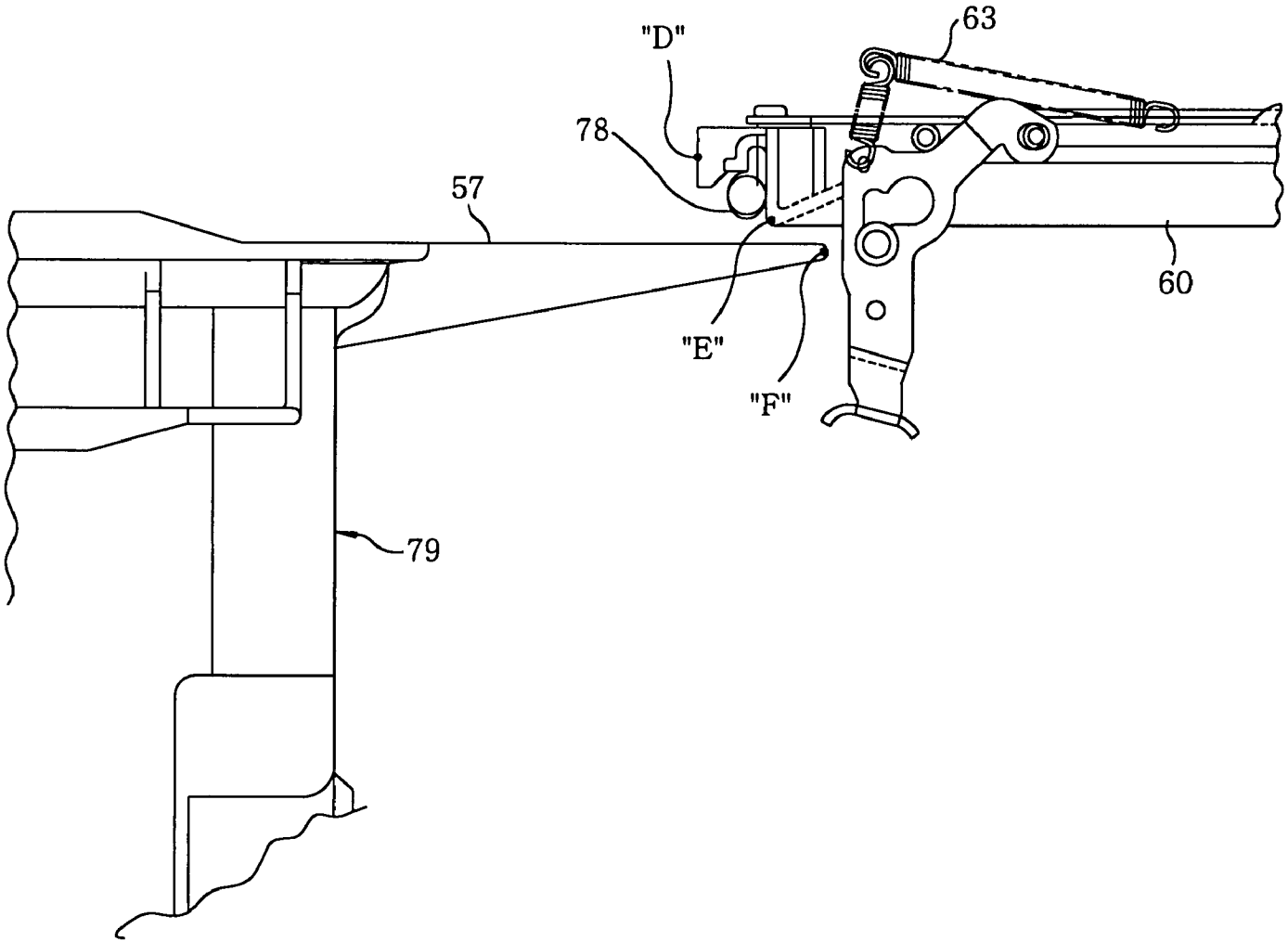
FIG. 15 exhibits a partial side view for setting forth a required length of an extension member of the washer tub.

The present invention further includes a pair of side covers 58 and top extension member 57 in order to block parts provided in space behind washer tub 32. Side covers 58 are attached on both sides of washer tub 32 above coupling portions 45 and extend backward therefrom. Side covers 58 and washer tub 32 can be made by resin molding as a single body. Top extension member 57 of a plate shape extends backward from the top rear end of tank 79, as shown in FIGS. 12 to 13B. Top extension member 57 is formed in such a manner that, when washer tub 32 is fully extracted from main body 31, its free end "F" is located under lid 60, as shown in FIG. 15.

Figure 14:
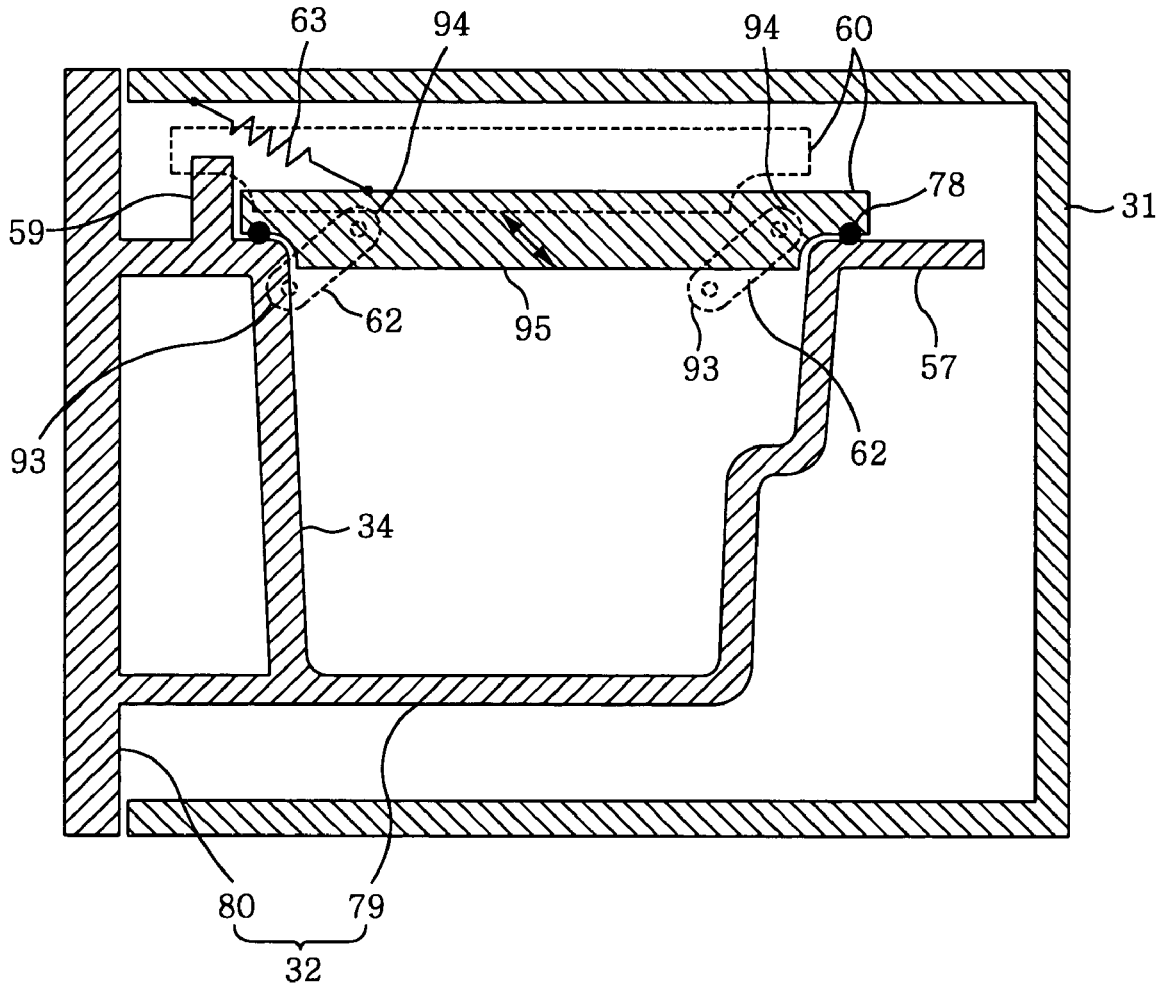
FIG. 14 displays a schematic cross sectional view for setting forth an arrangement of a lid of the washer tub.

Lid 60 is movably installed in main body 31 by means of link devices 62 and spring 63. More specifically, each link device 62 has a pair of pivoting ends, first pivoting end coupled to lid 60 via pivot 94 and second pivoting end coupled to main body 31 via pivot 93, imparting a translational motion to lid 60 with respect to pivots 93. Spring 63 is provided between main body 31 and lid 60 in order to bias lid 60 in a forward upward direction. This allows washer tub 32 to move to a position as indicated by a broken line in FIG. 14 when washer tub 32 is extracted from main body 31. While washer tub 32 is retracted into main body 31, lid 60 is pushed in a backward direction by pressing protrusion 59 formed at the upper front portion of tank 79 and moves against the biasing force of spring 63 to thereby move in a backward downward direction by means of the link device 62. When washer tub 32 is fully retracted into main body 31, i.e., up to a tub accommodation position at which washing operation is carried out, central portion 95 of lid 60 is fitted into the open top of inner tub 34 of washer tub 32, closing tank 79. At this time, inner tub 34 is sealed with packing 78 provided at bottom periphery of lid 60.

In case washer tub 32 is taken out from main body 31 and inner tub 34 of washer tub 32 is heavily loaded with dishes, its rear section and front section tend to be lifted and lowered respectively. For this reason, when washer tub 32 is retracted into main body 31, top extension member 57 extending from the rear upper portion of tank 79 may collide with front upper end "D" or front bottom end "E" of lid 60, as shown in FIG. 15, to impede a smooth operation of retracting washer tub 32. Therefore, in accordance with the present invention, top extension member 57 is designed in such a manner that, when washer tub 32 is fully extracted, i.e., up to the fully extracted position, its free end "F" is positioned at a location under central portion 95 of lid 60 and behind front bottom end "E" of lid 60. Therefore, while washer tub 32 is retracted into main body 31, top extension member 57 can move along a bottom surface of lid 60, guiding washer tub 32 to the tub accommodation position without being hindered by front upper end "D" and/or front bottom end "E" of lid 60. If it is only required to smoothly guide washer tub 32 into main body 31, at least one, e.g., two guide projections 57*a* extending partially from the rear upper end of washer tub 32 can be provided in lieu of top extension member 57, as shown in FIG. 13B.

If washer tub 32 is not completely retracted into main body 31 up to the tub accommodation position, inner tub 34 may be insufficiently sealed with lid 60 to result in water leakage or a latching operation, e.g., by way of using a handle locking washer tub 32 at the tub accommodation position, may not be properly operated. For this reason, the present invention further includes retraction mechanism 64 mounted on each of slide rail assemblies 33, for forcing washer tub 32 up to the tub accommodation position in main body 31 as shown in FIGS. 5, 6, 10A, 10B and 16.

Figure 16:
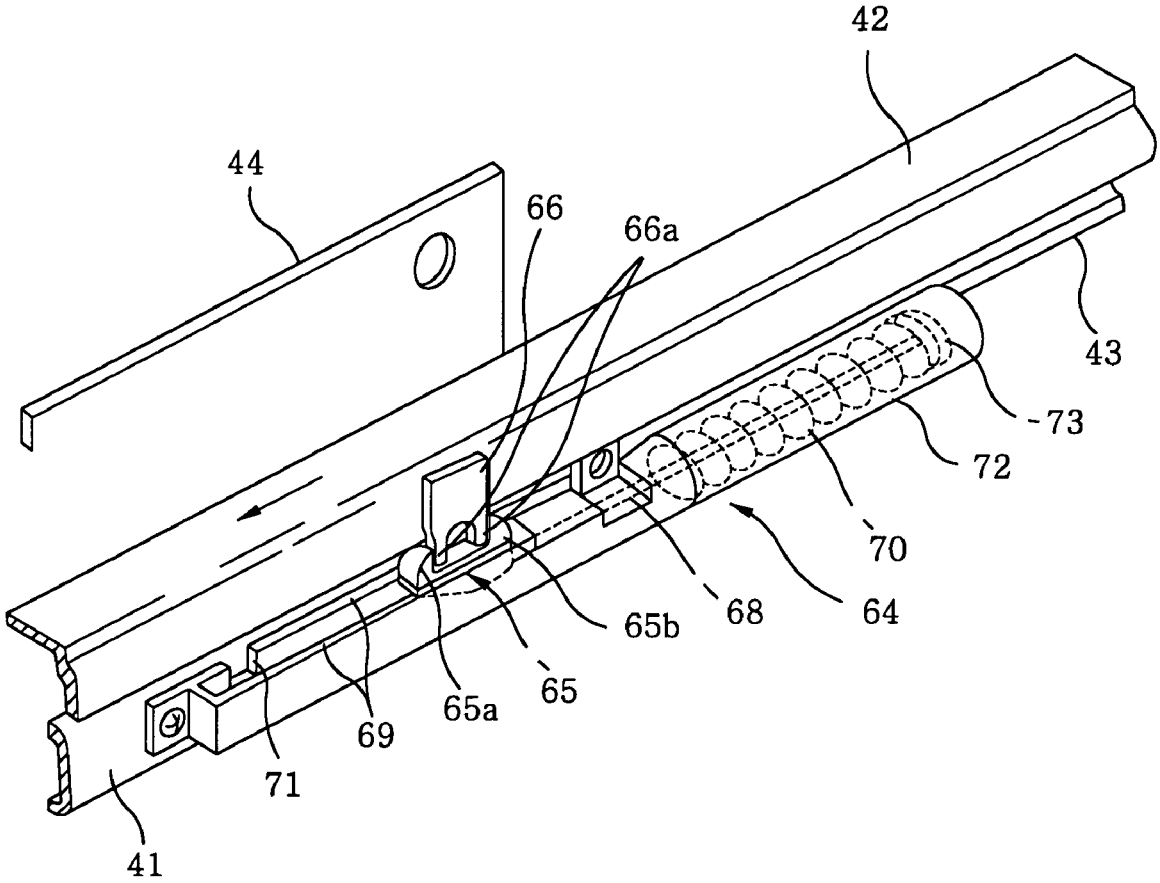
FIG. 16 reveals a perspective view of a retractable mechanism installed at the slide rail assembly.
Figure 17:
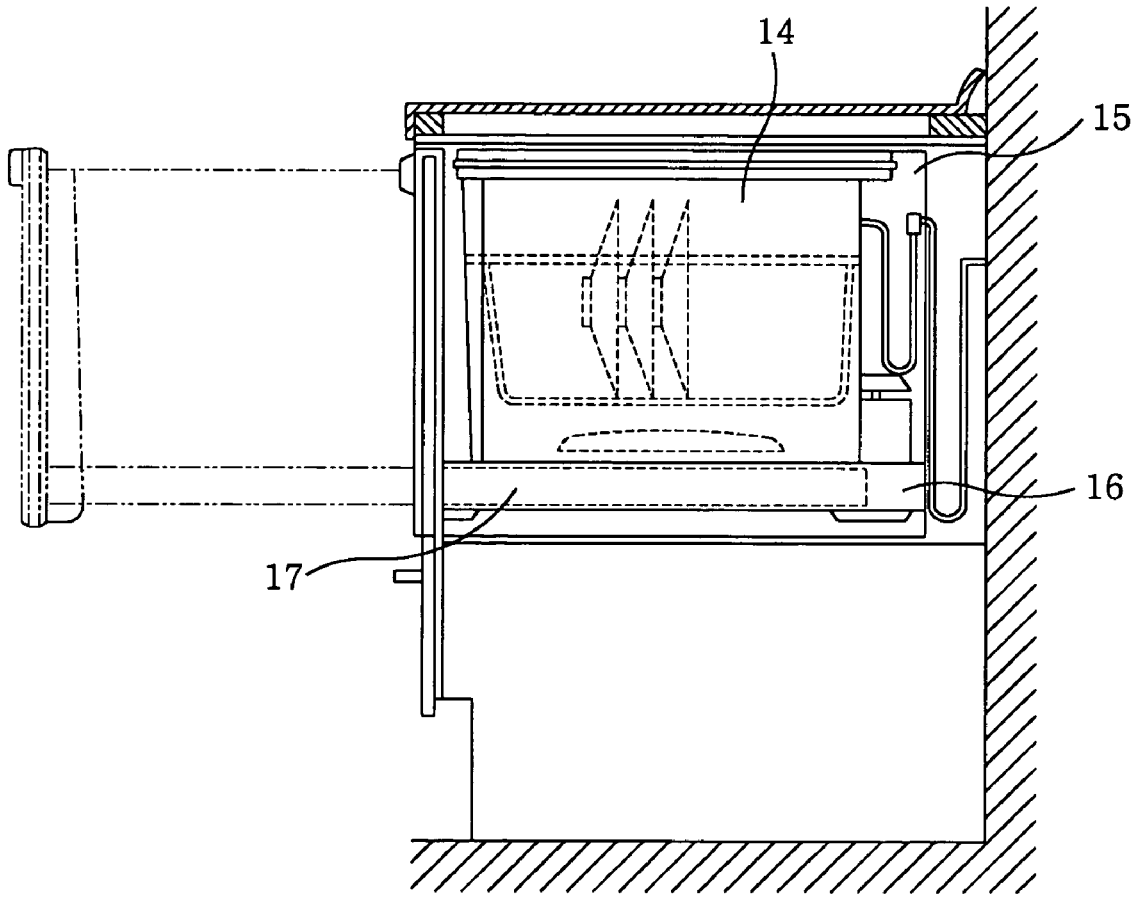
FIG. 17 (PRIOR ART)
FIG. 17 explains a side view showing an inner structure of a conventional dishwasher.

As shown in FIG. 16, retraction mechanism 64 is provided on one side of fixed rail 41 of slide rail assembly 33. Retraction mechanism 64 has coupling member 65 with a pair of coupling projections 65*a*, 65*b* spaced apart from each other, and one side surface of movable rail 42 is provided with engaging member 66 to be coupled with coupling member 65 through its protrusions 66*a*. When washer tub 32 is retracted into main body 31, protrusions 66*a* of engaging member 66 are inserted between coupling projections 65*a* and 65*b*. Engaging member 66 is movably coupled with one end of spring shaft 68, and the other end of spring shaft 68 is provided with spring support 73. Spring support 73 is accommodated in spring case 72 generally having a cylinder shape. Coil spring 70 is provided around spring shaft 68 within spring case 72.

When washer tub 32 begins to be extracted from main body 31, movable rail 42 and engaging members 66 fixed thereto travel together to move coupling member 65, which in turn pulls spring shaft 68 in a direction as indicated by an arrow in FIG. 16, compressing coil spring 70. Coupling member 65 is slidably guided along a groove defined by side walls 69 of retraction mechanism 64 and one of side walls 69 is provided with recess 71 for accommodating therein coupling projection 65*a*. Therefore, when coupling projection 65*a* coupled with engaging member 66 to be moved by movable rail 42 reaches recess 71, it is inserted into recess 71, releasing the engagement between coupling projection 65*a* and protrusions 66*a* of engaging member 66. Since the coupling projection 65*a* is kept in recess 71, coil spring remains to be compressed by spring support 73.

When washer tub 32 is retracted into main body 31, movable rails 42 are moved backward. When engaging member 66 reaches coupling member 65 located in recess 71, protrusion 66*a* of engaging member 66 is engaged with to press coupling projection 65*b* staying on side wall 69, which in turn releases coupling projection 65*a* of coupling member 65 from recess 71. Then, the restoring force of compressed coil spring 70 is exerted on engaging member 66 via spring shaft 68 and coupling member 65. This allows movable rail 42 to retract washer tub 32 up to the tub accommodation position without recourse to further external force for the retraction thereof.

In the retraction mechanism 64, spring case 72 has a cylinder shape and spring support 73 supports one end of coil spring 70 and simultaneously acts as a piston as well. For this reason, when compressed coil spring 70 returns, it is possible to obtain air damper effect of compressing air in spring case 72. Accordingly, as washer tub 32 approaches the tub accommodation position, moving speed decreases, thereby smoothly accommodate washer tub 32 therein.

While the invention has been shown and described with respect to the preferred embodiments, it will be understood by those skilled in the art that various changes and modifications may be made without departing from the spirit and scope of the invention as defined in the following claims.

What is claimed is:

1. A dishwasher comprising:

a main body being generally of a box shape with an open front;

a washer tub being extractable from and retractable into the main body through the open front by means of slide rail assemblies, the washer tub having an open top; and a covering member for blocking a gap to be opened between the washer tub and the main body when the washer tub is fully extracted from the main body, wherein, when the washer tub is fully extracted from the main body, a rear end of an inner rear wall of the washer tub is located in front of a front end of the main body and the gap is covered by the covering member, and wherein the covering member includes bottom covers, each bottom cover attached to a lower part of each side surface of the washer tub and extending downward and backward therefrom.

2. The dishwasher of claim 1, further comprising:

components disposed behind the washer tub in the main body, for feeding and draining water to and from the washer tub.

3. The dishwasher of claim 2, wherein the covering member includes side covers, each side cover extending backward from an upper part of each side surface of the washer tub.

4. The dishwasher of claim 2, wherein the covering member includes one or more top extension members, each top extension member extending backward from a top rear portion of the washer tub.

5. The dishwasher of claim 2, wherein the components include at least one electric part.

6. The dishwasher of claim 1, wherein the covering member includes side covers, each side cover extending backward from an upper part of each side surface of the washer tub.

7. The dishwasher of claim 1, wherein the covering member includes one or more top extension members, each top extension member extending backward from a top rear portion of the washer tub.

8. The dishwasher of claim 1, wherein said each side surface of the washer tub is parallel with a sliding direction of the washer tub and perpendicular to a bottom surface of the washer tub.

9. The dishwasher of claim 1, wherein the bottom covers conceal parts provided under the washer tub.

10. The dishwasher of claim 1, wherein a portion of said each bottom cover is located outside the main body when the washer tub is fully extracted from the main body.

11. The dishwasher of claim 1, wherein the slide rail assemblies includes movable rails provided on the main body and a pair of coupling portions provided on both side surfaces of the washer tub for the connection with the movable rails, and the bottom covers are attached under the coupling portions and extend downward up to a level below a bottom of the washer tub.

12. The dishwasher of claim 11, wherein the covering member further includes side covers attached to the side surfaces of the washer tub and extending backward therefrom, the side covers being disposed above the coupling portions.

13. A dishwasher comprising:

a main body being generally of a box shape with an open front;

a washer tub being extractable from and retractable into the main body through the open front by means of slide rail assemblies, the washer tub having an open top; and a covering member for blocking a gap to be opened between the washer tub and the main body when the washer tub is fully extracted from the main body, wherein, when the washer tub is fully extracted from the main body, a rear end of an inner rear wall of the washer tub is located in front of a front end of the main body and the gap is covered by the covering member, and wherein the covering member includes side covers, each side cover attached to an upper part of each side surface of the washer tub and extending backward therefrom.

14. The dishwasher of claim 13, further comprising:

components disposed behind the washer tub in the main body, for feeding and draining water to and from the washer tub.

15. The dishwasher of claim 14, wherein the covering member includes one or more top extension members, each top extension member extending backward from a top rear portion of the washer tub.

16. The dishwasher of claim 14, wherein the components include at least one electric part.

17. The dishwasher of claim 13, wherein the covering member includes one or more top extension members, each top extension member extending backward from a top rear portion of the washer tub.

18. The dishwasher of claim 13, wherein said each side surface of the washer tub is parallel with a sliding direction of the washer tub and perpendicular to a bottom surface of the washer tub.

19. The dishwasher of claim 13, wherein the side covers conceal parts provided behind the washer tub.

20. The dishwasher of claim 13, wherein a portion of said each side cover is located outside the main body when the washer tub is fully extracted from the main body.

* * * * *